US007779904B2

(12) United States Patent
Zhang

(10) Patent No.: US 7,779,904 B2
(45) Date of Patent: Aug. 24, 2010

(54) GUIDE RAIL PLATE FOR TOP DRIVE OF A DRILLING SYSTEM

(76) Inventor: Baoyou Zhang, No. 8-32 Minghu Commercial Street, Ranghu District, Daqing, Heilongjiang Province (CN) 163453

( * ) Notice: Subject to any disclaimer, the term of this patent is extended or adjusted under 35 U.S.C. 154(b) by 177 days.

(21) Appl. No.: 11/961,107

(22) Filed: Dec. 20, 2007

(65) Prior Publication Data

US 2008/0308319 A1 Dec. 18, 2008

(51) Int. Cl.
*E21B 19/00* (2006.01)
*E21B 15/00* (2006.01)

(52) U.S. Cl. ..... 166/85.5; 175/220

(58) Field of Classification Search ..... 175/220; 166/85.5

See application file for complete search history.

(56) References Cited

U.S. PATENT DOCUMENTS 4,837,992 A * 6/1989 Hashimoto ..... 52/118

* cited by examiner

*Primary Examiner*—Jennifer H Gay
*Assistant Examiner*—Catherine Loikith
(74) *Attorney, Agent, or Firm*—Cozen O'Connor

(57) ABSTRACT

A guide rail plate for top drive of a drilling system, including a guide rail plate consisting of 5-7 guide rail sections, characterized in that there is a boss and a mated recess on a surface of an upper guide rail section and an opposite surface of a lower guide rail section interconnected with the upper guide rail section. A hydraulic cylinder is centrally and longitudinally fixed at the lower end of the upper guide rail section. A cone plate is connected to the lower end of a piston of the hydraulic cylinder. The right and left sides of the cone plate are connected with lock shafts. The lock shafts are placed in corresponding transverse lock shaft holes of the upper and lower guide rail sections.

2 Claims, 4 Drawing Sheets

GUIDE RAIL PLATE FOR TOP DRIVE OF A DRILLING SYSTEM

FIELD OF THE INVENTION

This invention relates to a guide rail plate, especially for top drive of a drilling system in the oil-drilling field.

BACKGROUND

With more and more deep wells, super deep wells and complex wells during oil and gas exploration and development, the demand for top drive machine in China is becoming more and more urgent, especially for foreign bidding projects, it is hardly possible to win the bid without top drive machines. Users and the market recognize the top drive machine, and it becomes the standard configuration of the drilling machine. The top drive machine gives the power to directly rotate a drill tool from the derrick top, and entirely reforms the traditional rotary table drilling method. In addition, the top drive machine can complete many operations such as recycling the drilling fluid, connecting the stand, screwing and unscrewing. It can increase drilling efficiency, greatly reduce the possibility of the drill pipe sticking and the risk of exploration and development, and promote the automation progress of the offshore drilling and the land drilling technology. To control the rotation of the power equipment, it is necessary to vertically install the guide rail plates between the top of the derrick of the top drive machine and drilling table. The guide rail plates consist of the 5-6 m-long guide rail sections connected together. However, it must takes 4-6 operators 8-12 hours to load or unload the guide rail plate by using 1-2 hoists, resulting in wasting time and effort, low handling efficiency, high handling cost and complex operation. Furthermore, due to the high-altitude operations, there is a potential safety problems, it is not conducive to promoting application.

DISCLOSURE OF THE INVENTION

To solve the above mentioned problems of the existing top drive machine guide rail plate such as wasting time and effort, low handling efficiency, high handling cost, complex operation and potential safety problem, the present invention supply a guide rail plate for top drive of the drilling system, which overcome the technical problems of prior art mentioned above. Comparing with prior art, this invention has such advantages as time and labor saving, high handling efficiency, and low handling cost, easy operation, high safety and reliability.

The technical proposal of this invention is as follows: A guide rail plate for top drive of the drilling system includes a guide rail plate consisting of 5-7 guide rail sections. There are a boss and a matched recess on the opposite faces of connected-together upper and lower guide rail sections; there are hinge lugs on the right and left side of both ends of the upper guide rail sections respectively, and there are hinge lugs on the right and left side of both ends of the lower guide rail sections too; the matched hinge lugs on the upper and lower guide rail sections were connected by the hinges of the pins; a hydraulic cylinder is centrally longitudinally fixed at the lower end of the upper guide rail sections; a cone plate is connected to the lower end of the piston of the hydraulic cylinder; there are lock shafts on the right and left side of the cone plate; the lock shafts are placed in the transversal lock shaft holes corresponding to the upper and lower guide rail sections; the hydraulic cylinder is connected to the hydraulic pump via an oil pipe, and the hydraulic pump is fixed in the lower end of guide rail sections at the lowest end of the guide rail plate.

The above-mentioned hydraulic pump is a manual hydraulic pump.

This invention has the following beneficial effects. In the installation of this guide rail plate for top drive of the drilling system, due to use the above-mentioned technical, the rope of the guide rail plate top is hung on the hook on the derrick and the folded guide rail plates are hoisted by the hooks, so top of the guide rail plate is fixed on the upper end of the derrick via the rope, and the lower end of the guide rail plate is fixed on the drilling table; and then the manual hydraulic pump pushes the lock shafts into the lock shaft holes corresponding to the upper and lower guide rail sections, then the upper and lower guide rail plates are firmly locked immediately. It takes only 1-2 operators less than an hour to install the guide rail plates by using the hook on the derrick, so it can decrease the number of operators, work without power equipment, reach the target of time and labor-saving, increase handling efficiency, decrease handling cost, simplify operation process, and eliminate potential safety problem.

BRIEF DESCRIPTION OF DRAWINGS

In FIG. 1—the upper guide rail sections, 2—the lower guide rail sections, 3—boss, 4—recess, 5—hinge lug, 6—pins, 7—hydraulic cylinder, 8—cone plate, 9—lock shaft, 10—lock shaft hole

DETAILED DESCRIPTION OF SPECIFIC EMBODIMENT

Figure 1:
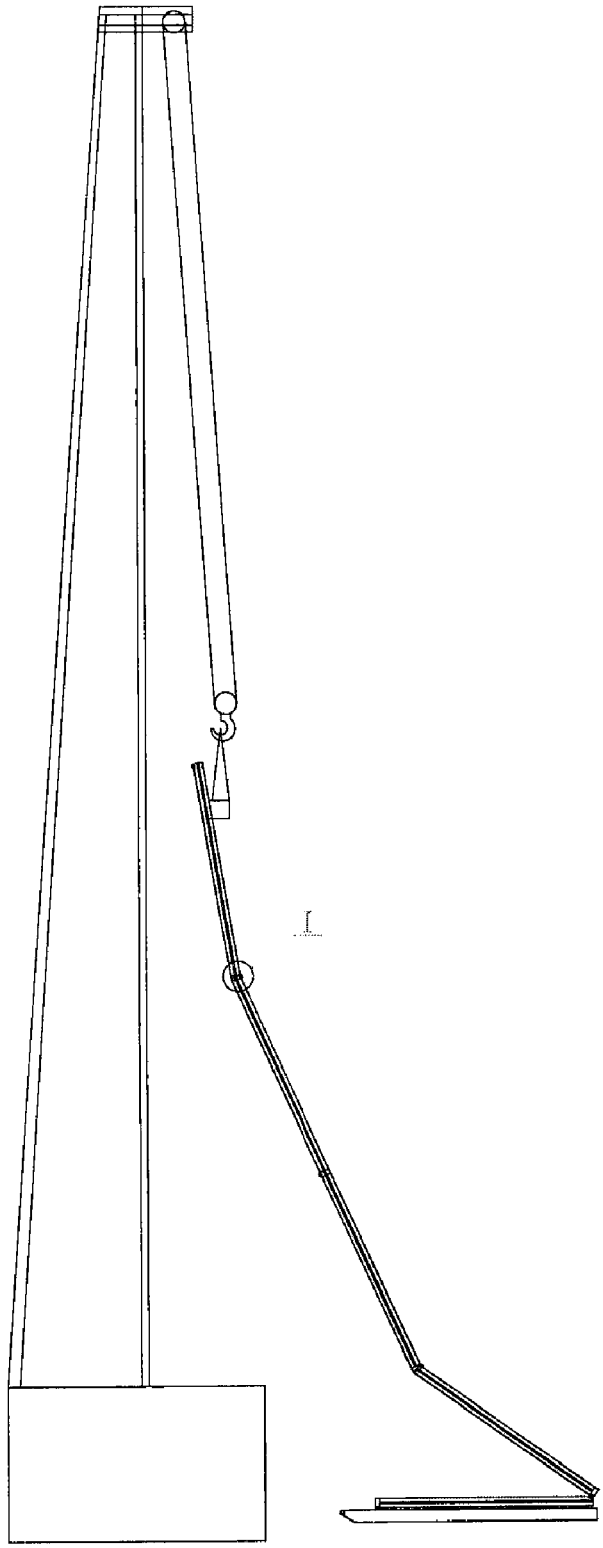
FIG. 1 is a structural schematic view during handling of the embodiment of the present invention model.
Figure 2:
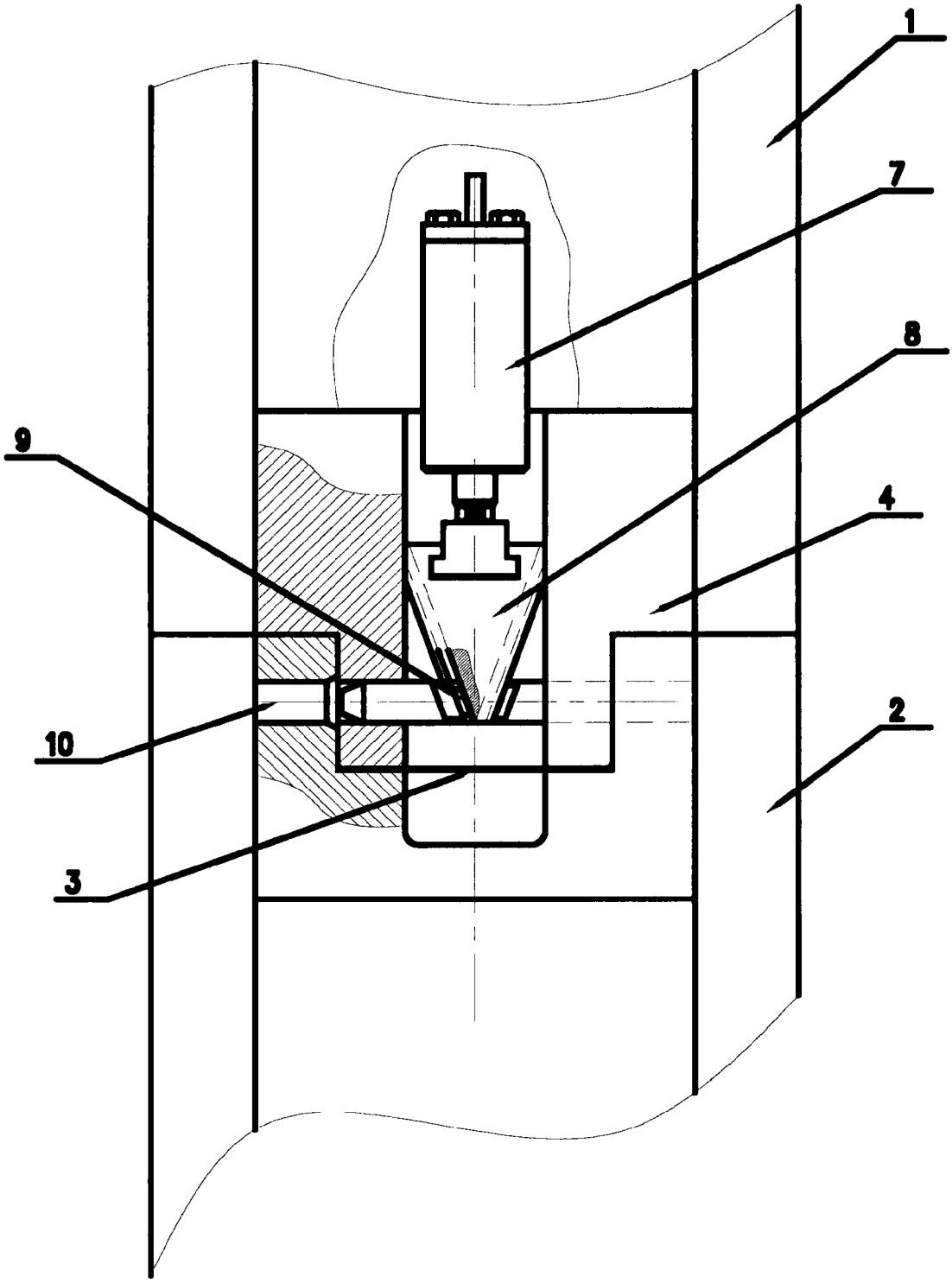
FIG. 2 is a sectional profile view of selective enlargement at I in FIG. 1.
Figure 3:
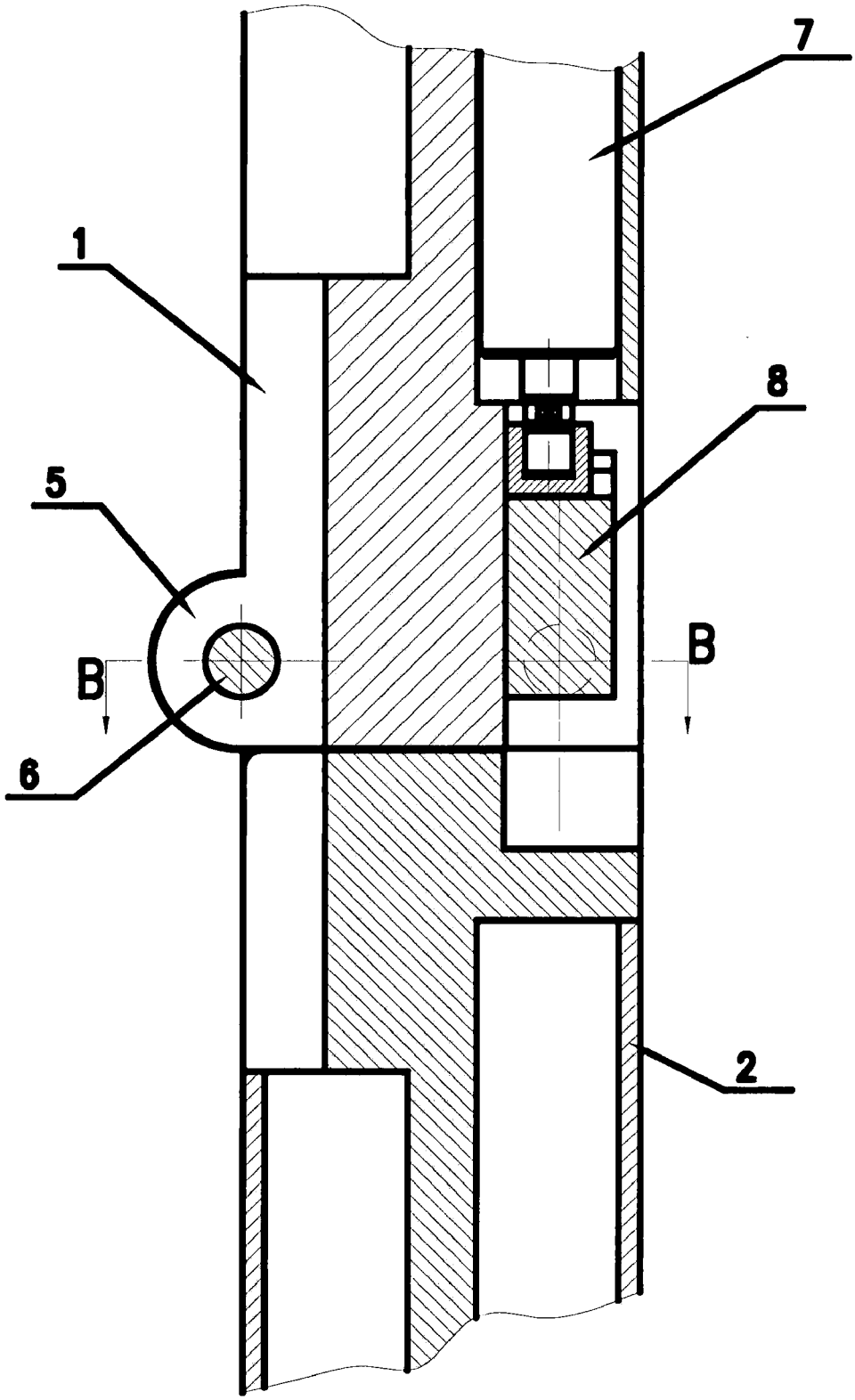
FIG. 3 is a left side view of FIG. 2.
Figure 4:
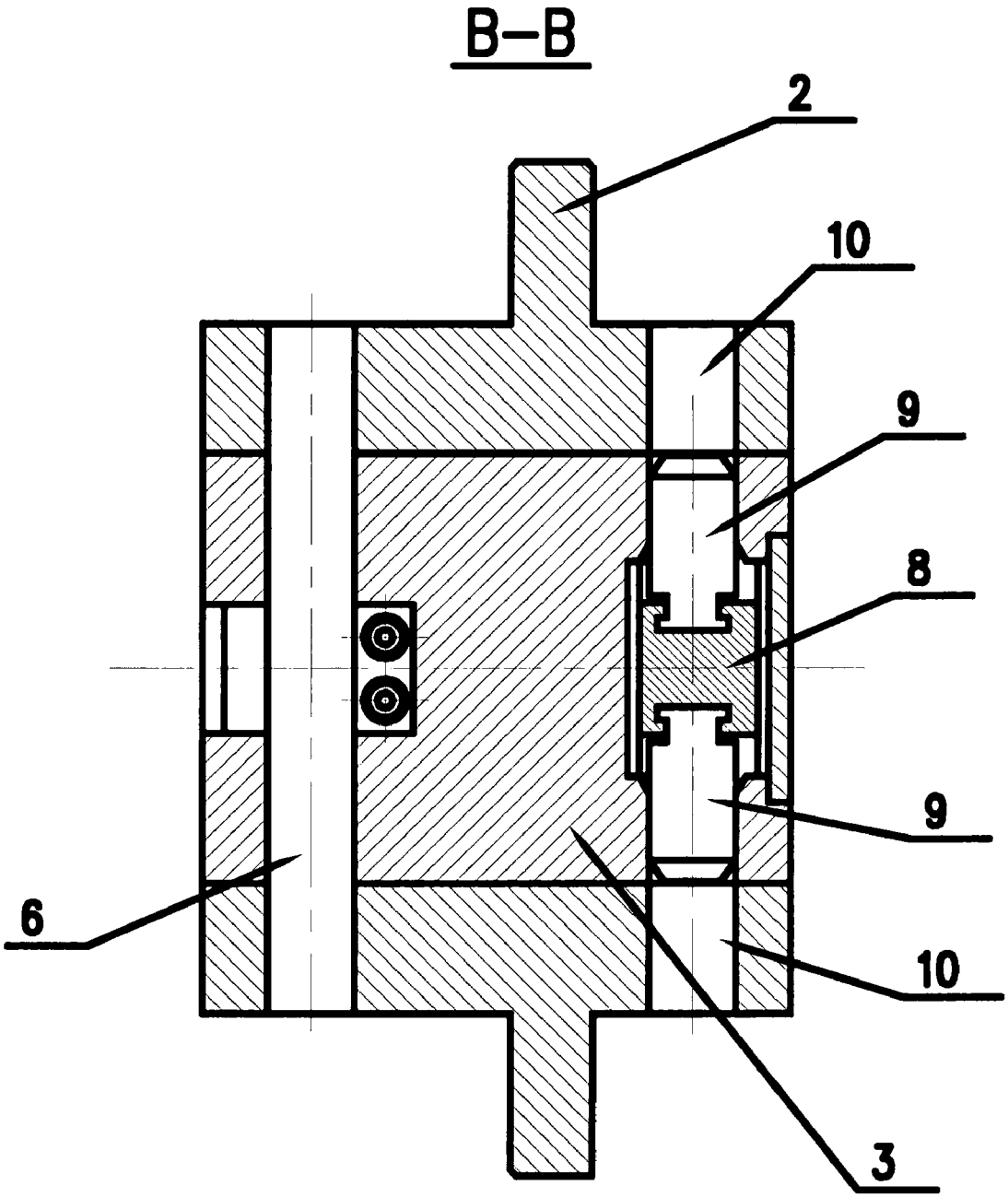
FIG. 4 is a profile view along line B-B in FIG. 3.

This invention is further described according to the drawings as follows:

As shown in FIGS. 1, 2, 3 and 4, the guide rail plate for top drive of the drilling system consists of 5-7 guide rail sections, there is a pair of boss (3) and recess (4) on the opposite surfaces of inter-linked upper guide rail section (1) and lower guide rail section (2); the connection of the boss (3) and the recess (4) increases the torsional strength of the guide rail plates; there are hinge lugs (5) on the right and left side of both ends of the upper guide rail sections (1) respectively, there are hinge lugs (5) on the right and left side of both ends of the lower guide rail sections (2), too; the corresponding hinge lugs (5) on the upper and lower guide rail sections (1,2) were connected by the hinges of the pins (6), so the guide rail plates is foldaway, resulting in their reduced length and easy installation and transportation; a hydraulic cylinder (7) is centrally longitudinally fixed at the lower end of the upper guide rail sections (1); a cone plate (8) is connected to the lower end of the piston of the hydraulic cylinder (7); some lock shafts (9) are connected on the right and left side of the cone plate (8); the said lock shafts (9) are placed in the corresponding transversal lock shaft holes (10) on the upper guide rail section (1) and lower guide rail section (2); the hydraulic cylinder (7) is connected to the manual hydraulic pump via an oil pipe, which simplify the structure because of working without power equipment; the manual hydraulic pump is fixed in the lower end of the lowest guide rail section of the guide rail plate; the manual hydraulic pump and the hydraulic cylinder (7) push the cone plate (8) to move upwards and downwards to further drive the lock shafts (9) into and out of the lock shaft holes (10), and finally realize automatic locking or unlocking.

During installation, the folded guide rail plates are carried near the drilling table, the upper end of the guide rail plate at the topmost of them is hung on the hook of the derrick via a rope, and the guide rail plate is hoisted via the lift hook. When the guide rail plate reaches the designed height, the topmost of the guide rail plate is fixed on the derrick by the rope. During hoisting, the upper guide rail sections (1) and the lower guide rail sections (2) rotate around the pin (6) as an axis to make the boss (3) at the lower end of the connected-together upper guide rail sections (1) insert into the matched recess (4) at the upper end of the lower guide rail sections (2), so it increase the strength of the guide rail plates and assure the linearity of the guide rail plates. After that, the hydraulic oil, which is pumped by the manual hydraulic pump at the lowest end of the guide rail plates, push the piston of the hydraulic cylinder (7) out and the piston of the hydraulic cylinder (7) drives the cone plate (8) to move downwards, the conical surfaces on both sides of the cone plate (8) push the lock shafts (9) into the lock shaft holes (10) of the upper guide rail sections (1) and the lower guide rail sections (2) so that the upper guide rail sections (1) and the lower guide rail sections (2) are firmly locked and can not rotate around the pin (6) as an axis. The lowest end of the guide rail plate is also fixed on the drilling table before taking the rope out of the lift hook. The installation is finished. During dismounting, at first the upper end of the guide rail plate is put on the lift hook on the derrick via a rope. Then the manual hydraulic pump in the lowest end of the guide rail plate reversely outputs the hydraulic oil to drive the piston of the hydraulic cylinder (7) to shrink inwards, and then the piston pull the cone plate (8) to move upwards. The conical surfaces on both sides of the cone plate (8) pull the lock shafts (9) to shrink inwards and get out of the lock shaft hole (10) so that the upper guide rail section (1) and the lower guide rail section (2) are unlocked and make them rotate around the pin (6) as an axis. The rope fixed the topmost end of the guide rail plate is dismounted, and the lift hook is put down. The hinge lugs (5), which are fixed on the left side of the upper end and the right side of the lower end of the guide rail sections, cause the guide rail plates to be folded around the pins (6) as an axis in order to shorten the length of the guide rail plates. The folded plate can be loaded via the lift hook on the derrick and transported away. The dismounting is finished. During mounting and dismounting, 1-2 operators operate the manual hydraulic pump, the hydraulic cylinder (7), the cone plate (8) and the lock shaft (9) to realize automatic locking or connecting to unfold the guide rail plates without a hoist, so it reaches the target of time and labor-saving, increases handling efficiency, decreases handling cost, simplifies operation process, and eliminates potential danger of high-altitude operation.

All in all, this guide rail plate for top drive of the drilling system has such advantages as saving time and labor, high handling efficiency, low handling cost, easy operation, high safety and reliability.

The invention claimed is:

1. A guide rail plate for top drive of a drilling system, including a guide rail plate consisting of 5-7 guide rail sections, characterized in that there is a boss (3) and a mated recess (4) on a surface of an upper guide rail section (1) and an opposite surface of a lower guide rail section (2) interconnected with the said upper one respectively; first hinge lugs (5) are fixed on the right and left side of both ends of the said upper guide rail section (1) respectively, and second hinge lugs are fixed on the right and left side of both ends of the said lower guide rail section (2); the first and second hinge lugs on the upper and lower guide rail sections (1,2) are connected by pins (6) respectively; a hydraulic cylinder (7) is centrally longitudinally fixed at the lower end of the said upper guide rail section (1); a cone plate (8) is connected to the lower end of a piston of said hydraulic cylinder (7); the right and left sides of the cone plate (8) are connected with lock shafts (9); the said lock shafts (9) are placed in corresponding transverse lock shaft holes (10) of the upper and lower guide rail sections (1,2); the hydraulic cylinder (7) is connected to a hydraulic pump via oil pipe, and the hydraulic pump is fixed in the lower end of the bottom guide rail section of the guide rail plate.

2. The guide rail plate for top drive of the drilling system according to claim 1, characterized in that the said hydraulic pump is a manual hydraulic pump.

* * * * *